US006352332B1

(12) United States Patent
Walker

(10) Patent No.: US 6,352,332 B1
(45) Date of Patent: Mar. 5, 2002

(54) METHOD AND APPARATUS FOR PRINTING ZONE PRINT MEDIA EDGE DETECTION

(75) Inventor: Steven H. Walker, Camas, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/349,734

(22) Filed: Jul. 8, 1999

(51) Int. Cl.[7] ..... B41J 29/393
(52) U.S. Cl. ..... 347/19
(58) Field of Search ..... 347/19, 104; 399/389; 250/559.19, 559.18, 559.12, 559.36, 559.37; 356/383

(56) References Cited

U.S. PATENT DOCUMENTS

| | | | | |
|---|---|---|---|---|
| 4,617,470 A | * | 10/1986 | Horikawa | 250/559.36 |
| 4,786,803 A | | 11/1988 | Majette et al. | 250/237 |
| 4,789,874 A | | 12/1988 | Majette et al. | 346/140 |
| 5,170,047 A | | 12/1992 | Beauchamp et al. | 250/202 |
| 5,252,991 A | | 10/1993 | Storlie et al. | 346/108 |
| 5,261,038 A | | 11/1993 | Adroher et al. | 395/103 |
| 5,262,797 A | | 11/1993 | Boeller et al. | 346/1.1 |
| 5,289,208 A | | 2/1994 | Haselby | 346/140 |
| 5,397,192 A | | 3/1995 | Khormaee | 400/708 |
| 5,404,020 A | | 4/1995 | Cobbs | 250/548 |
| 5,446,559 A | | 8/1995 | Birk | 358/473 |
| 5,448,269 A | | 9/1995 | Beauchamp et al. | 347/19 |
| 5,451,990 A | | 9/1995 | Sorenson et al. | 347/37 |
| 5,466,079 A | | 11/1995 | Quintana | 400/579 |
| 5,564,848 A | | 10/1996 | Quintana | 400/708 |
| 5,574,551 A | | 11/1996 | Kazakoff | 399/45 |
| 5,600,350 A | | 2/1997 | Cobbs et al. | 347/19 |
| 5,825,378 A | | 10/1998 | Beauchamp | 347/19 |
| 5,835,108 A | | 11/1998 | Beauchamp et al. | 347/19 |
| 6,042,228 A | * | 3/2000 | Yamada et al. | 347/104 |

* cited by examiner

*Primary Examiner*—John Barlow
*Assistant Examiner*—Julian D. Huffman

(57) ABSTRACT

A media edge detection method and apparatus for hard copy apparatus uses a scanning-carriage-based optical sensor. Scan reflectance data from the print medium and the platen is compared to calculated shaped data to get a cumulative error. Recursively converging the data to a best fit, the shaped data reflective transition point is substituted as a true edge position.

33 Claims, 5 Drawing Sheets

METHOD AND APPARATUS FOR PRINTING ZONE PRINT MEDIA EDGE DETECTION

BACKGROUND OF THE INVENTION

1. Field of the Invention

The present invention relates generally to ink-jet printing and, more specifically, to print media edge detection using an optical sensing device.

2. Description of Related Art

The art of ink-jet technology is relatively well developed. Commercial products such as computer printers, graphics plotters, copiers, and facsimile machines employ ink-jet technology for producing hard copy. The basics of this technology are disclosed, for example, in various articles in the *Hewlett-Packard Journal*, Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No.1 (February 1994) editions. Ink-jet devices are also described by W. J. Lloyd and H. T. Taub in *Output Hardcopy* [sic] *Devices,* chapter 13 (Ed. R. C. Durbeck and S. Sherr, Academic Press, San Diego, 1988).

In essence, the ink-jet printing process involves dot-matrix manipulation of drops of ink ejected from a pen onto an adjacent print medium (for convenience of explanation, the word "paper" is used hereinafter as generic for all forms of print media). An ink-jet pen includes a printhead which consists of a number of columns of ink nozzles, with each typically having a diameter of only about 1/300th inch. A column of nozzles (typically less than or equal to one-inch in total height) selectively fires ink droplets (typically only a few picoliters in liquid volume) that are used to create a predetermined print matrix of dots on the adjacently positioned paper as the pen is scanned across the media. A given nozzle of the printhead is used to address a given matrix column print position on the paper, referred to as a picture element, or "pixel." Horizontal positions on the paper are addressed by repeatedly firing a given nozzle at matrix row print positions as the pen is scanned. Thus, a single sweep scan of the pen across the paper can print a swath of dots. The paper is stepped to permit a series of contiguous swaths. Dot matrix manipulation is used to form alphanumeric characters, graphical images, and even photographic reproductions from the ink drops.

Paper position during printing is of course a prime factor to the quality of the print. Two basic types of prior solutions to determining the side edge of the media are interrupters and edge guides. An "interrupter," whether optical or capacitive type, is mounted in a known, fixed position relative to the nominal paper movement. The interrupter switch binary output merely tells if the media edge is present within the field of view of the interrupter. Edge determination is made by sampling a paper advance axis encoder and the interrupter state. However, this gives no direct data with regard to the edge's real time position relative to the printing zone of the printer and its writing instrument or plurality of writing instruments. The second type, known as "edge guides" are positioned relative to the paper edge by the printer user. Print media edge detection relies on the known printer's paper width and length by using adjusters to mechanically position the paper sheet relative to the hard copy apparatus printing zone and writing instruments. Edge position is inferred from the adjustment. For example, U.S. Pat. No. 5,574,551 (Kazakoff) for a PRINT MEDIA SUPPLY APPARATUS WITH MEDIA PARAMETER DETECTION CAPABILITY (assigned to the common assignee of the present invention and incorporated herein by reference) provides for size detection in the paper supply bin.

The position of the paper transported to a printing station of the hard copy apparatus must be known or determined for the droplets of ink to be appropriately registered on the paper. The more detailed the print, e.g., a photographic or art reproduction, the more critical the drop placement in order to avoid noticeable artifacts.

U.S. Pat. No. 5,466,079 (Quintana) shows a APPARATUS FOR DETECTING MEDIA LEADING EDGE AND METHOD FOR SUBSTANTIALLY ELIMINATING PICK SKEW IN A MEDIA HANDLING SUBSYSTEM and its divisional U.S. Pat. No. 5,564,848 (Quintana) shows a METHOD AND APPARATUS FOR DETECTING MEDIA SHEET EDGES WITH A COMMON, MOVABLE OPTICAL SENSOR (each assigned to the common assignee of the present invention and incorporated herein by reference). An electro-optic sensor detects when the top of a media sheet enters between a drive roller and a pinch roller and the media is manipulated to be squared up.

In U.S. Pat. No. 5,252,991 (Storlie et al.) (assigned to the common assignee of the present invention and incorporated herein by reference) for a MEDIA EDGE SENSOR UTILIZING A LASER BEAM SCANNER, a scanning system moves the light beam across the media sheet and past its edges to cause the beam to fall on beam sensor when the media sheet is partially shadowing the beam sensors. A processor is responsive to outputs from the beam sensors to determine positional information regarding the media sheet. Positional information is derived by determining the time during which the scanned beam is incident on a sensor. In U.S. Pat. No. 5,446,559 (Birk) (assigned to the common assignee of the present invention and incorporated herein by reference), a handheld scanner is moved over the edge of the printed page to calibrate the position of the scanner with respect to the sheet of paper.

The state of the art devices leave some degree of uncertainty as to the real time position and skew of the paper once transported to the printing zone and while being stepped through the printing zone. This is particularly problematical in full-bleed ink-jet printing, i.e., printing to or very near the edges, such as might be desirable for photographic reproductions. Thus, there remains a need for making real time determinations of paper edge position when the paper sheet is in the hard copy apparatus printing station.

SUMMARY OF THE INVENTION

In its basic aspects, the present invention provides a method for detecting print medium edge position in a hard copy apparatus having a printing zone including a platen having a width greater than a predetermined maximum width for print media used with the hard copy apparatus. The method includes the steps of: transporting a sheet of the print media into the printing zone for printing on the sheet with a writing instrument; scanning across the printing zone with an optical sensing device having a known field of view; while scanning, recording a series of reflectance readings from the sheet and from the platen at a platen region adjacent at least one edge of the sheet; storing the reflectance readings as a first data set; calculating a second data set based on the first data set and the known field of view; calculating a best fit of the second data set to the first data set; and determining a reflectance transition point location in the printing zone of the best fit wherein the transition reflectance transition point is representative of the print media sheet edge position.

It is another basic aspect of the present invention to provide an ink-jet hard copy apparatus adapted for using a variety of print media, including: a printing station within the apparatus, the printing station fabricated of a material having a predetermined first reflectivity recognizably differing from reflectivity of blank print media, the printing station having a width greater than a predetermined width equal to a maximum usable print media width; a scanning carriage mounted within the apparatus for selectively scanning across the printing station width; an encoder system associated with the carriage for tracking position of the carriage; a plurality of printheads fixedly mounted to the carriage; an optical detector fixedly mounted to the carriage in a predetermined relationship to the printheads, the detector having a known field of view; and a control mechanism for selectively determining true edge position of at least one edge of a sheet of print medium positioned at the printing station by comparing a reflectivity data set obtained with the optical detector from the sheet and from the material by scanning the detector across the sheet a distance greater than a nominal width of the sheet to obtain positionally related reflectivity values from both the blank print media and the material to a calculated data set constructed from the reflectivity data and the predetermined field of view and for calculating the true sheet edge position therefrom.

In another basic aspect, the present invention provides a hard copy apparatus, including: holding mechanisms for holding a sheet of print media in selective orientations while printing is performed thereon; at least one writing mechanism for printing associated with the mechanisms for holding; mounting mechanisms for fixedly mounting the writing mechanisms thereon and for selectively positioning the writing mechanisms with respect to the holding mechanisms; tracking mechanisms for tracking predetermined positions of the mounting mechanisms while the mounting mechanism is selectively positioning the writing mechanisms; fixedly mounted on the mounting mechanisms, detecting mechanisms for determining reflectivity at the predetermined positions within the holding mechanisms, including across an edge of the sheet in a first direction of travel of the mounting mechanisms, the detecting mechanisms having known operating parameters; and controlling mechanisms for compiling a first data set from the detecting mechanisms, the first data set being representative of actual reflectivity values, including reflectivity values of the sheet and of the holding mechanisms; and calculating mechanisms for calculating a second data set representative of data compiled by the detecting mechanisms and of the known operating parameters of the detecting mechanisms and for comparing the second data set to the first data set such that a best fit of the second data set to the first data set provides a transition value representative of position of the edge of the sheet.

In another basic aspect, the present invention provides a method for ink-jet printing with, including the steps of: a) providing at least one ink-jet writing instrument fixedly mounted in a hard copy apparatus for scanning across a print media platen; b) providing at least one optical scanning device, having known operating characteristics, fixedly mounted in a known relationship to the writing instrument for scanning across the print media platen therewith; c) transporting a sheet of print media to a printing zone on the platen wherein the sheet has a predetermined nominal position on the platen; d) optically scanning across a region of the sheet near a first edge thereof with the optical scanning device while recording media reflectivity data therefrom with respect to known positions across the platen; e) optically scanning across the first edge of the sheet while recording reflectivity transition data between the sheet and the platen; f) optically scanning across a region of the platen while recording platen surface reflectivity data therefrom; g) calculating a true position of the edge of the sheet from the recording media reflectivity data, the reflectivity transition data, the platen surface reflectivity data, the known operating characteristics of the optical scanning device, and the optical scanning device known relationship to the writing instrument; and h) printing images with the writing instrument relative to the true position of the edge.

In another basic aspect, the present invention provides a computer memory device including: mechanisms for recording a series of reflectance readings from the sheet and from the platen adjacent at least one edge of the sheet; mechanisms for storing the reflectance readings as a first data set; mechanisms for calculating a second data set based on the first data set and the known field of view; mechanisms for calculating a best fit of the second data set to the first data set; and mechanisms for determining a reflectance transition point location in the printing zone of the best fit wherein the transition reflectance transition point is representative of the print medium edge position.

It is an advantage of the present invention that it provides a method and apparatus for optically determining print medium edge position in real time with a print medium in the printing zone.

It is an advantage of the present invention that measurement of print medium edge position at differing points during paper advance produces a measurement of print medium skew.

It is another advantage of the present invention that it is sufficiently fast to calculate position while simultaneously printing adjacently to an edge, enabling full-bleed printing adjustments.

It is a further advantage of the present invention that it does not require any optically detectable markings to be made on the print medium.

It is an advantage of the present invention that it provides a solution that does not require additional edge detector components to an ink-jet hard copy apparatus.

It is another advantage of the present invention that by using existing product devices manufacturing costs are not increased.

It is still another advantage of the present invention that it can be used to measure accumulative tolerance with respect to the print medium, enabling loosening of mechanical part tolerances and thus lowering manufacturing costs.

It is another advantage of the present invention that by using existing product devices it reduces the potential of added complexity lowering reliability.

It is a further advantage of the present invention that it is applicable to all hard copy apparatus platforms.

It is a further advantage of the present invention that it is a relative measurement, requiring no calibration.

It is a further advantage of the present invention that it is implementable automatically as a programmed algorithm, requiring no end user intervention.

The foregoing summary and list of advantages is not intended by the inventors to be an inclusive list of all the aspects, objects, advantages and features of the present invention nor should any limitation on the scope of the invention be implied therefrom. This Summary is provided in accordance with the mandate of 37 C.F.R. 1.73 and M.P.E.P. 608.01(d) merely to apprize the public, and more especially those interested in the particular art to which the invention relates, of the nature of the invention in order to be of assistance in aiding ready understanding of the patent in future searches. Other objects, features and advantages of the present invention will become apparent upon consideration of the following explanation and the accompanying drawings, in which like reference designations represent like features throughout the drawings.

The drawings referred to in this specification should be understood as not being drawn to scale except if specifically noted.

DESCRIPTION OF THE PREFERRED EMBODIMENT

Reference is made now in detail to a specific embodiment of the present invention, which illustrates the best mode presently contemplated by the inventor for practicing the invention. Alternative embodiments are also briefly described as applicable. While the present invention is described in terms of an exemplary embodiment of a computer peripheral ink-jet printer, it will be recognized by those skilled in the art that the technology is applicable to other implementations. No limitation on the scope of the invention is intended by the inventors in using this exemplary embodiment nor should any such limitation be implied therefrom.

Figure 1:
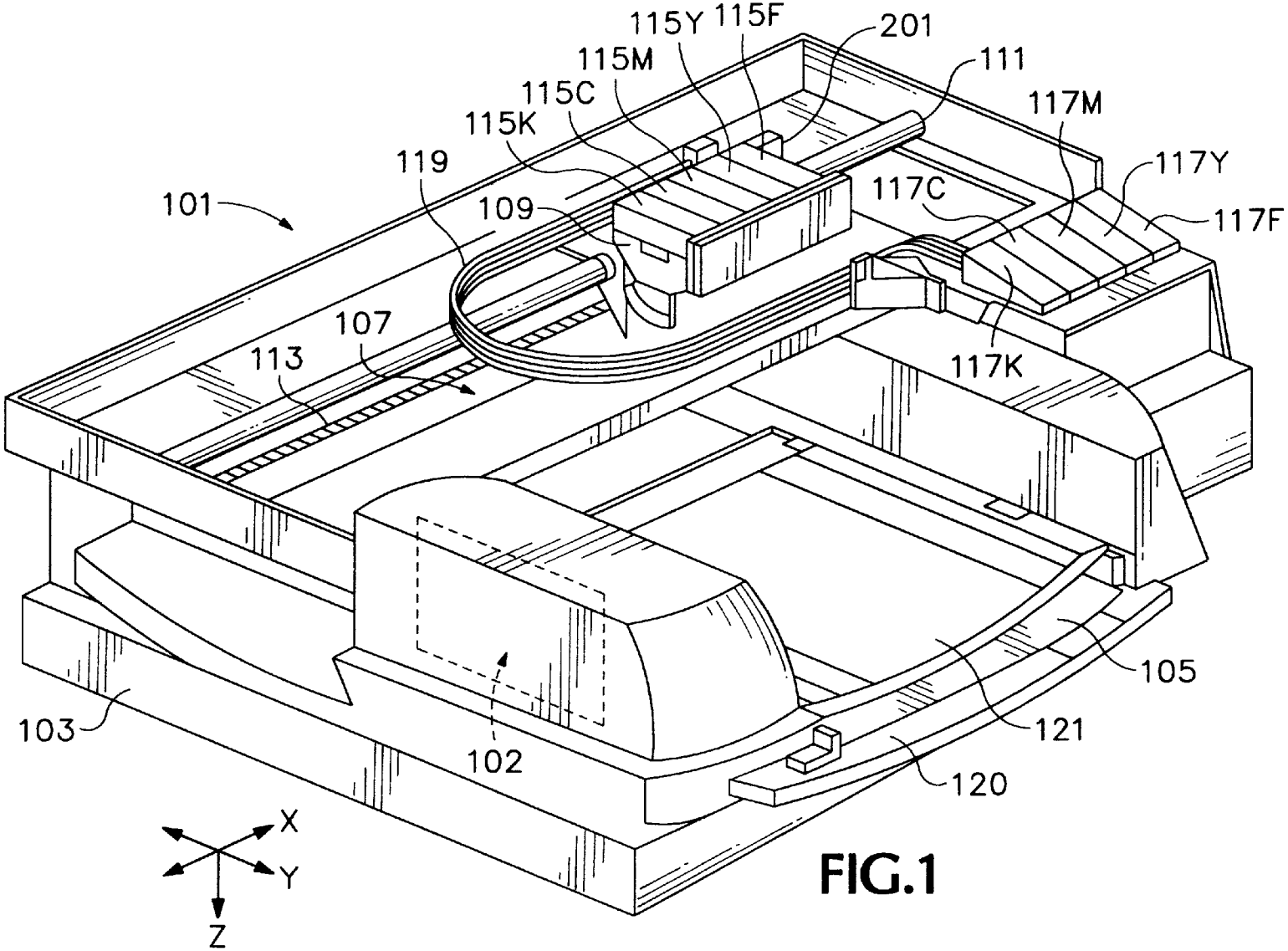
FIG. 1 is an ink-jet printer embodiment of the present invention.

FIG. 1 depicts an ink-jet hard copy apparatus, in this exemplary embodiment, a computer peripheral, color printer, 101. A housing 103 encloses the electrical and mechanical operating mechanisms of the printer 101. Operation is administrated by an internal electronic controller 102 (usually a microprocessor or application specific integrated circuit ("ASIC") controlled printed circuit board) connected by appropriate cabling (not shown) to the computer. It is well known to program and execute imaging, printing, print media handling, control functions, and logic with firmware or software instructions for conventional or general purpose microprocessors or ASIC's. Cut-sheet print media 105 (again, referred to generically hereinafter simply as "paper," regardless of actual medium selected by the end-user) is loaded by the end-user onto an input tray 120. Sheets of paper are then sequentially fed by a suitable, internal, paper-path transport mechanism to a printing station pivot, "printing zone," 107—also referred to in the art as a "platen"—where graphical images or alphanumeric text are created using state of the art color imaging and text rendering techniques. A carriage 109, mounted on a slider 111, scans the paper sheet delivered to the printing zone 107. An encoder strip 113 and appurtenant position encoding devices on the carriage 109 and as part of the controller 102 firmware are provided for keeping track of the position of the carriage 109 at any given time during a scan across the paper. A SINGLE CHANNEL ENCODER SYSTEM and a SINGLE CHANNEL ENCODER WITH SPECIFIC SCALE SUPPORT STRUCTURE are described by Majette et al. in U.S. Pat. Nos. 4,789,874 and 4,786,803, respectively (assigned to the common assignee of the present invention and incorporated herein by reference). A set of individual ink-jet writing instruments, "pens," 115K, 115C, 115M, 115Y, 115F, each having ink-jet printheads as would be known in the art (not seen in this perspective), are releasably mounted in fixed positions on the carriage 109 for easy access and repair or replacement. Each printhead mechanisms is adapted for "jetting" minute droplets of ink or other fluids to form dots on adjacently positioned paper in the printing zone 107. Refillable or replaceable ink cartridges 117K, 117C, 117M, 117Y are provided; generally, in a full color ink-jet system, inks for the subtractive primary colors, Cyan, Yellow, Magenta (CYM) and a true black (K) ink are used; note however that additive primary colors—red, blue, green—or other colorants can be used). In this set, a pen 115F and cartridge 117F for a clear fluid, ink fixer "F," is also provided. The pens 115 are coupled to their respective cartridges by flexible ink feed tubing 119. Once a printed page is completed, the sheet of paper is ejected onto an output tray 121. It is common in the art to refer to the pen scanning direction as the x-axis, the paper feed direction as the y-axis, and the ink drop firing direction as the z-axis.

Figure 2:
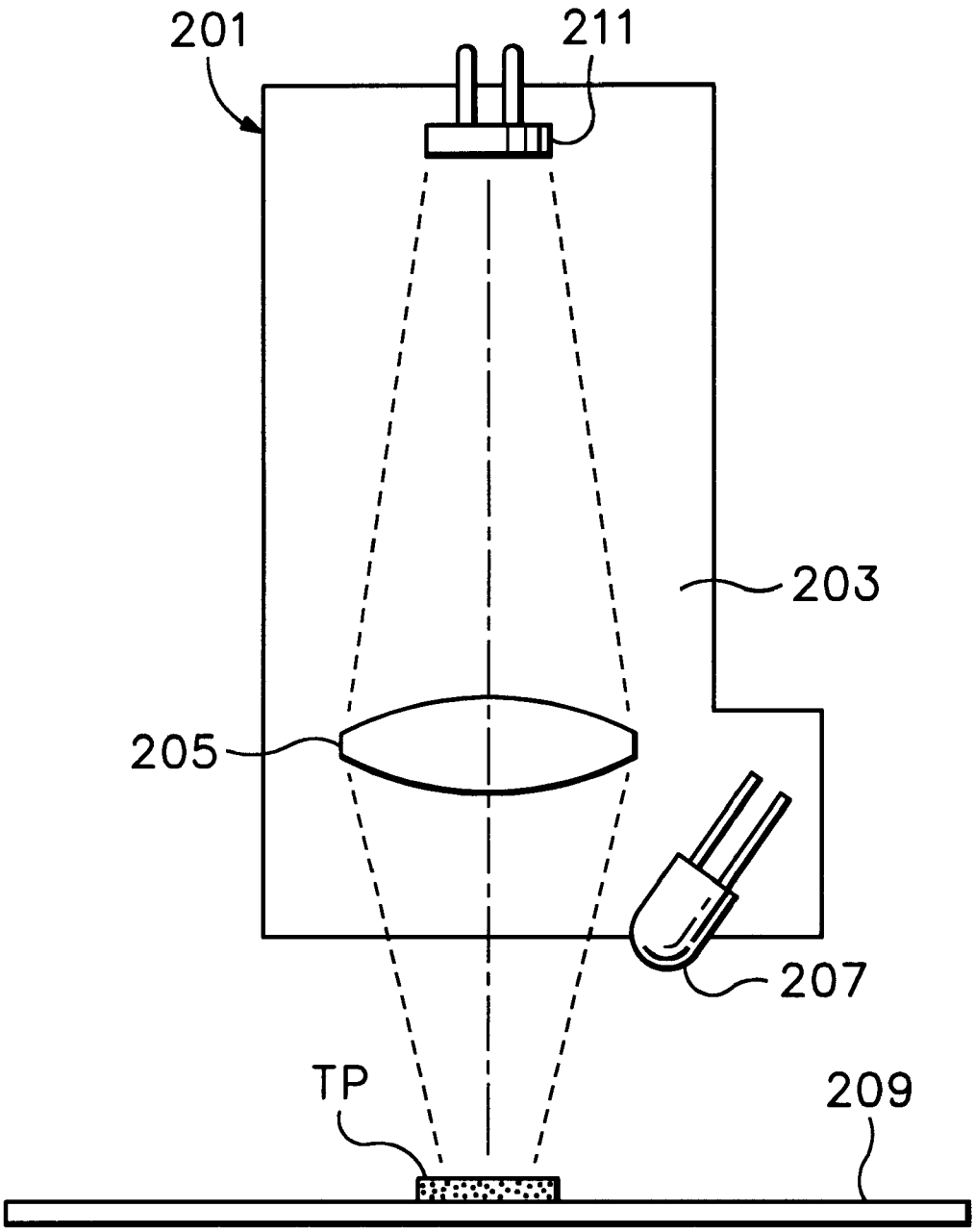
FIG. 2 is an exemplary optical sensor as employed in the present invention as shown in FIG. 1.

FIG. 2 is a schematic depiction of an optical sensor unit used in accordance with the present invention. Ink-jet nozzles of the printheads are generally in-line with the sensor module 201 in the x-axis by fixedly mounting the module 201 appropriately on the carriage 109 (FIG. 1). The sensor module 201 optically detects reflectivity values and provides electrical signals to the controller 102 and a controller based media alignment algorithm, described in detail hereinafter. An optical component holder 203 contains a lens 205. One or more light-emitting diodes ("LEDs") 207 are mounted at an angle to the plane of the printing zone 107 (FIG. 1). The LEDs 207 project light (which can also be focused via a lens—not shown) onto the media or a printed a test pattern "TP" printed with the printheads on the paper 209 (see e.g., Cobbs et al., supra)., and the light is then reflected to a photodetector 211. Known manner optical sensing and analog-to-digital ("A/D") signal process techniques are applied. For further details regarding a specific, multifunction, optical sensor module useful in accordance with the present invention, reference can be made to U.S. patent application Ser. No. 09/183,086 (filed Oct. 28, 1998 by WALKER et al. or U.S. Pat. No. 5,170,047 (Beauchamp et al.) for an OPTICAL SENSOR FOR PLOTTER PEN VERIFICATION (both assigned to the common assignee of the present invention and incorporated herein by reference).

Figure 3A:
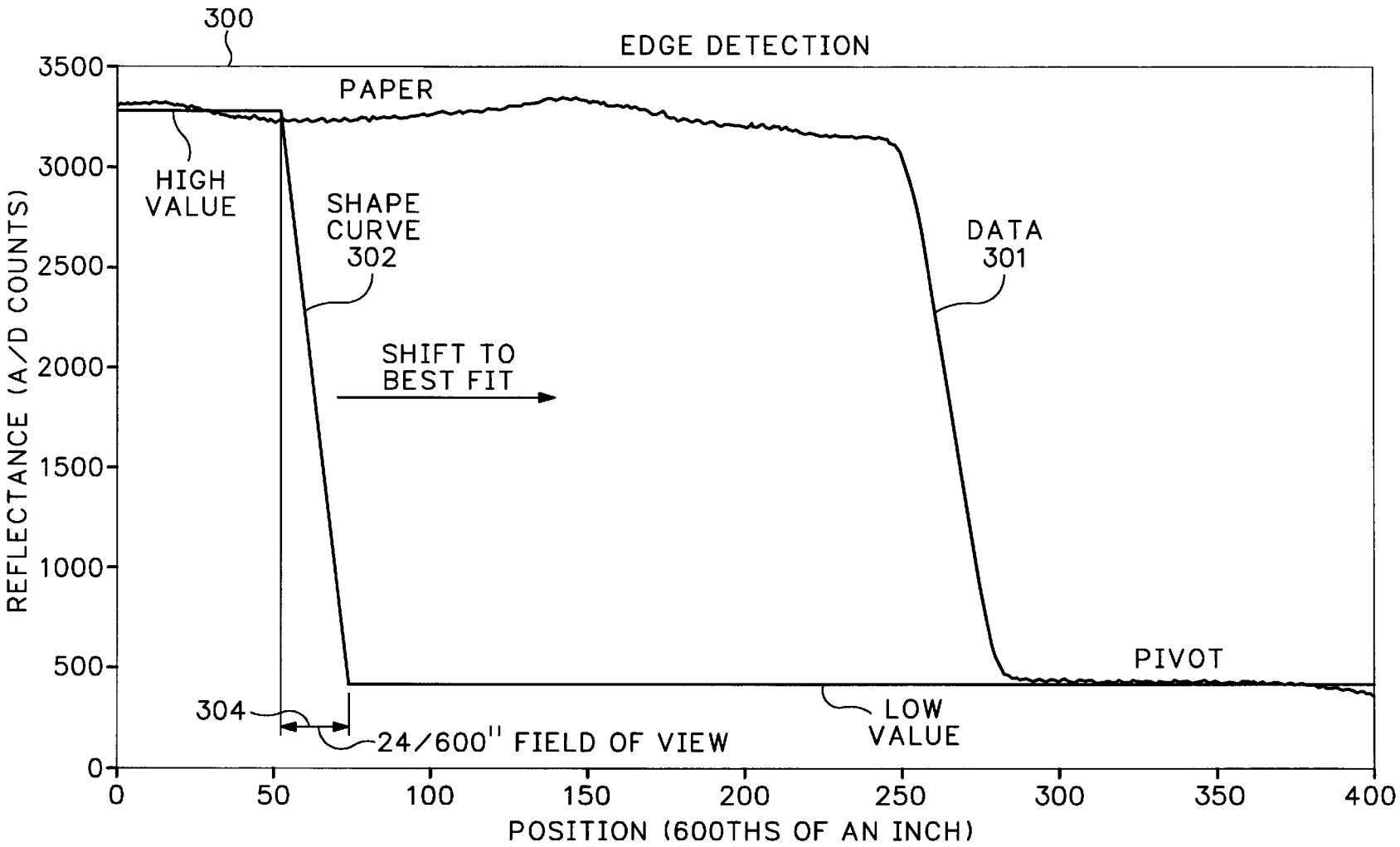
FIGS. 3A and 3B are an exemplary data plot in accordance with the present invention.
Figure 4:
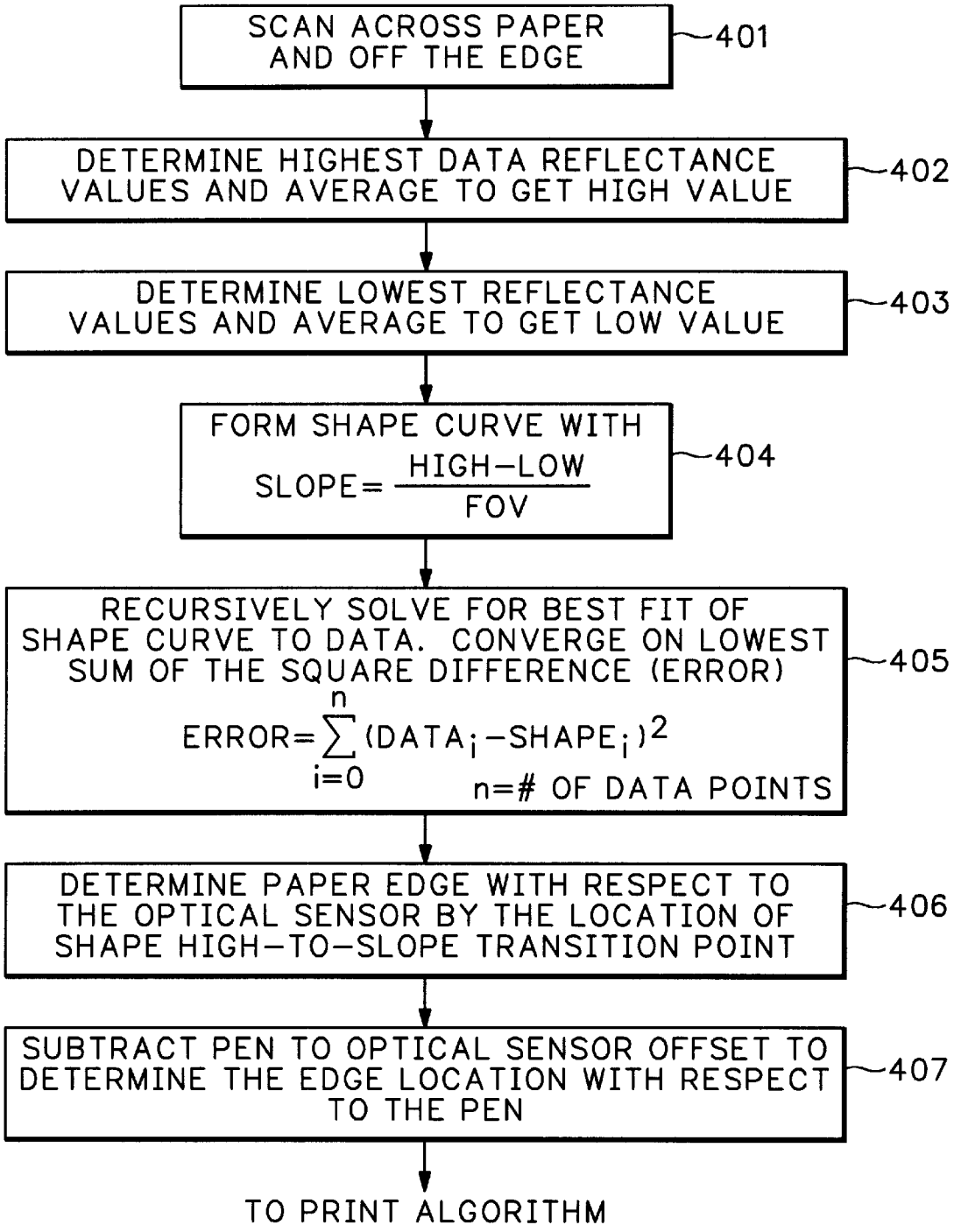
FIG. 4 is a flow chart detailing the steps of the process of the present invention.

FIG. 3A is a graph 300 showing Edge Detection data, with Position plotted against Reflectance, and a calculated plot as described hereinafter. FIG. 4 is a flow chart of the edge detection process algorithm. Referring also to FIGS. 1 and 2 regarding hardware elements of the system, a sheet of paper 105 from the input tray 120 is transported to the printing zone 107 where it would have a nominal position based on prior art technology. The optical sensor 201 is adjusted to bring the signal off a blank sheet of paper up to the near-saturation level of the photodetector's 211 A/D converter, e.g., five volts. Then the carriage 109 scans across the paper, off the edge of the paper and over the pivot 107, step 401; the raw data set acquired is represented by a plot in FIG. 3A, Data Curve 301.

Figure 3B:
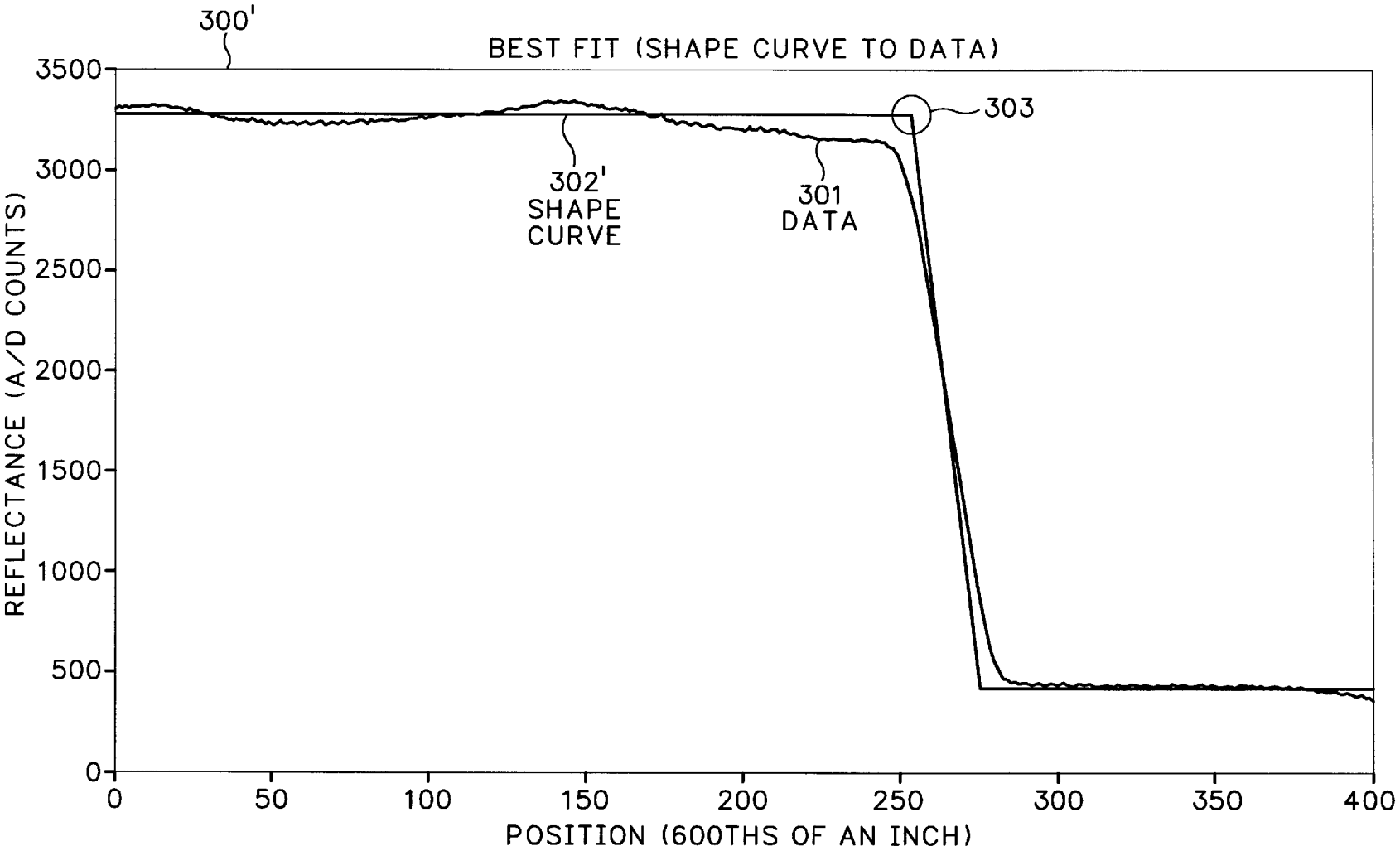

Data acquisition consists of recording the reflectance at every encoder 113 transition across the scan width of the carriage 109. The high values represent reflectance from blank paper. The low values represent reflectance from the pivot 107 itself, where the pivot is manufactured preferably of a black plastic, or other suitable material having low reflectivity compared to blank paper. The data set thus consists of position and corresponding reflectance data (reflectance and position in A/D counts). The sampling rate is spatial, typically occurring at six-hundred samples per inch, or as otherwise determined by the encoder 113 resolution. Note that scanning for data can be reversed, from pivot onto paper. Multiple scans across the edge before averaging can be used to fine tune noise out of the data, such as random ambient light fluctuations. Typically, one to three scans are made across the edge of the sheet. In FIGS. 3A and 3B it can be seen that four hundred data points are gathered across the edge.

Once scans are completed, the controller 102 CPU is notified that the data collection is complete so that it can perform the edge detection algorithm steps. An average is calculated for paper reflectance and pivot reflectance, steps 402, 403. A sample of five to fifty values is used.

Knowing the field of view 304 of the specific sensor 201 employed, also known as the "run"—e.g., 24/600th inch for the device employed to render plot 301 data of FIGS. 3A and 3B (a suitable, commercially available model is the HBCS 1100 manufactured by Hewlett-Packard Optoelectronics which has a run of 5/600ths-inch)—the calculated average high and low reflectance data are used, step 404, to form a Shape Curve 302 data base in accordance with Equation 1:

slope=(high average reflectance−low average reflectance)÷field of view (Equation 1).

To find the nominal edge position to true edge position "error," step 405, the shaped plot 30 is moved through the data recursively to solve for the best fit, converging on the lowest sum of the square difference in accordance with Equation 2:

$$\text{error} = \sum_{i=0}^{n} (data_i - shape_i)^2, \qquad \text{(Equation 2)}$$

where n=number of averaged data points.

This is graphically represented by plot 300' of FIG. 3B, with shifted Shape Curve 302'. Note that summing the errors by simple linear summing can be employed, but it is known that taking the sum of the squares will give more weight to large errors and thus provide a more accurate edge detection result.

Next, step 406, the location of the best fit, shaped curve, high-to-low point transition is selected as the paper edge, circled 303 in FIG. 3B.

Next, the pen, or pens, 115 known, or calculated, carriage mounting offset from the sensor 201 in the x-axis is used to adjust the calculation of the paper edge with respect to each pen, step 407, adding or subtracting the offset appropriately for left-edge or right-edge determinations relative to each printhead nozzle column relative position.

This optically determined paper edge position relative to each pen is sent to the controller's print algorithm. For example, the firmware sets a non-volatile memory with the value of the calculated location of the edge to be used at a later time.

Alternatively, the shape curve comparison can also be limited to the sloped portion which in comparison to the actual data sloped portion and the edge position determined from that smaller data base. However, this may result in a lower accuracy factor.

It should be noted that a true edge position determination can be made for each swath to be printed. For example, when printing on eleven-inch, letter size, paper, for a one-inch high nozzle array, the carriage based edge detector algorithm can quickly calculate the true edge position before printing each of the eleven swaths.

A variety of determinations can be made with the present invention. Determining the position of the print side right edge can be used to provide an indication of whether the paper is standard letter or metric A-4 size. Optically measuring both side edges of the current sheet of paper in accordance with the process steps also allows determination of the media width. Measuring at least one edge at differing points during paper advance produces a measurement for calculating media skew, namely from the change in edge position compared to a previous edge position. Note that the process can be used to determine the leading and trailing edge position to increase the accuracy of a printer's out of paper sensor. As will be recognized by a person skilled in the art, the field-of-view in the y-axis may be different from the x-axis field-of-view operation as discussed above and must be taken into account in making positional determinations. The same sensor measurement and algorithm can be run to measure any offset due to mechanical tolerances between the carriage home position and the left edge of the paper.

Thus, the present invention provides a means for making an accurate determination of the real time position of a current sheet of paper in the hard copy apparatus printing zone.

The foregoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents. Reference to an element in the singular is not intended to mean "one and only one" unless explicitly so stated, but rather means "one or more." Moreover, no element, component, nor method step in the present disclosure is intended to be dedicated to the public regardless of whether the element, component, or method step is explicitly recited in the following claims. No claim element herein is to be construed under the provisions of 35 U.S.C. Sec. 112, sixth paragraph, unless the element is expressly recited using the phrase: "means for . . . "

What is claimed is:

1. A method for detecting print medium edge position in a hard copy apparatus having a printing zone including a platen having a width greater than a predetermined maximum width for print media used with the hard copy apparatus, the method comprising the steps of:

transporting a sheet of the print media into the printing zone for printing on the sheet with a writing instrument;

scanning across the printing zone with an optical sensing device having a known field of view;

while scanning, recording a series of reflectance readings from the sheet and from the platen at a platen region adjacent at least one edge of the sheet;

storing the reflectance readings as a first data set;

calculating a second data set based on the first data set and the known field of view;

calculating a best fit of the second data set to the first data set; and determining a reflectance transition point location in the printing zone of the best fit wherein the transition reflectance transition point is representative of the print media sheet edge position.

2. The method as set forth in claim 1, comprising the further steps of:

adjusting the print media sheet edge position with respect to any known offset between the writing instrument to the optical sensor.

3. The method as set forth in claim 1, the step of storing the reflectance readings as a first data set further comprising:

plotting the data as a first curve.

4. The method as set forth in claim 3, the step of calculating a second data set further comprising:

forming a representative plot having a high value approximately equal to the average of the high values of the first curve and a low value approximately equal to the average of the low values of the first curve and a transition region having a slope calculated in accordance with the equation:

slope=(high average reflectance−low average reflectance)÷field of view.

5. The method as set forth in claim 4, the step of calculating a best fit of the data curve to the first data set further comprising:

recursively finding a best fit of the representative plot to the first curve.

6. The method as set forth in claim 4, the step of calculating a best fit of the data curve to the first data set further comprising:

summing the errors by simple linear summing, sorting for the lowest sum difference.

7. The method as set forth in claim 5, the step of recursively finding a best fit of the representative plot to the first curve further comprising:

converging on a lowest sum of square differences in accordance with the equation:

$$\text{error} = \sum_{i=0}^{n} (\text{data curve}_i - \text{shape curve}_i)^2,$$

where n=number of averaged data points.

8. The method as set forth in claim 1, further comprising:

the known field of view is a value in a print zone, writing instrument scanning axis for determining left and right media edge position.

9. The method as set forth in claim 1, further comprising:

the known field of view is a value in a print zone, print media translation axis for determining top and bottom media edge position.

10. An ink-jet hard copy apparatus adapted for using a variety of print media, comprising:

a printing station within the apparatus, the printing station fabricated of a material having a predetermined first reflectivity recognizably differing from reflectivity of blank print media, the printing station having a width greater than a predetermined width equal to a maximum usable print media width;

a scanning carriage mounted within the apparatus for selectively scanning across the printing station width;

an encoder system associated with the carriage for tracking position of the carriage;

a plurality of printheads fixedly mounted to the carriage;

an optical detector fixedly mounted to the carriage in a predetermined relationship to the printheads, the detector having a known field of view; and a control mechanism for selectively determining true edge position of at least one edge of a sheet of print medium positioned at the printing station by comparing a reflectivity data set obtained using the optical detector by scanning the detector across the sheet a distance greater than a nominal width of the sheet to obtain positionally related reflectivity values from both the blank print media and the material to a calculated data set constructed from the reflectivity data and the predetermined field of view and for calculating the true sheet edge position therefrom, wherein the control mechanism includes an algorithm running mechanism for recursively fitting the calculated data set to the reflectivity data set to determine an error value representative of the true edge position.

11. The apparatus as set forth in claim 10, the algorithm running mechanism further comprising:

means for plotting the reflectivity data set as a representative first curve, means for plotting the calculated data set by forming a representative plot having a high value approximately equal to the average of the high values of the first curve and a low value approximately equal to the average of the low values of the first curve and a slope region in accordance with the equation:

slope=(high average reflectance−low average reflectance)÷field of view, and means for recursively finding a best fit of the representative plot to the first curve.

12. The apparatus as set forth in claim 11, the means for recursively finding a best fit further comprising:

means for converging on a lowest sum of square differences in accordance with the equation:

$$\text{error} = \sum_{i=0}^{n} (\text{data curve}_i - \text{shape curve}_i)^2,$$

where n=number of averaged data points.

13. The apparatus as set forth in claim 10, the algorithm running mechanism further comprising:

means for outputting a location of a fitted shape curve transition point position as the true edge position.

14. The apparatus as set forth in claim 10, the algorithm running mechanism further comprising:

means for adjusting the print medium edge position with respect to any known writing instrument to optical sensor offset.

15. A hard copy apparatus, comprising:

holding means for holding a sheet of print media in selective orientations while printing is performed thereon;

at least one writing means for printing associated with the means for holding;

mounting means for fixedly mounting the writing means thereon and for selectively positioning the writing means with respect to the holding means;

tracking means for tracking predetermined positions of the mounting means while the mounting means is selectively positioning the writing means;

fixedly mounted on the mounting means, detecting means for determining reflectivity at the predetermined positions within the holding means, including across an edge of the sheet in a first direction of travel of the mounting means, the detecting means having known operating parameters; and controlling means for compiling a first data set from the detecting means, the first data set being representative of actual reflectivity values, including reflectivity values of the sheet and of the holding means; and calculating means for calculating a second data set representative of data compiled by the detecting means and of the known operating parameters of the detecting means and for comparing the second data set to the first data set such that a best fit of the second data set to the first data set provides a transition value representative of position of the edge of the sheet.

16. The apparatus as set forth in claim 15, comprising:

the known operating parameters include known optical field of view, FOV, in an x-axis, where the x-axis is a scanning axis for the mounting means across the holding means.

17. The apparatus as set forth in claim 16, comprising:

the known operating parameters include known optical field of view a y-axis, where the y-axis is a paper path axis through the holding means perpendicular to the x-axis.

18. The apparatus as set forth in claim 15, the calculating means further comprising:

a data processing controller for plotting the first data set as a DATA CURVE of reflectance counts against mounting means position across an edge of the sheet and an uncovered region of the mounting means adjacent the edge, wherein HIGH reflectance counts are reflectivity values from the sheet and LOW reflectance counts are reflectivity values from the region, forming a SHAPE CURVE having a high SHAPE CURVE value equal to the average of the HIGH reflectance counts and a low SHAPE CURVE value equal to the average of the LOW reflectance counts and a SLOPE region therebetween in accordance with an equation, $$\text{slope}=(\text{HIGH average reflectance}-\text{LOW average reflectance})\div\text{FOV},$$

recursively solving for a best fit of the SHAPE CURVE to the DATA CURVE, and determining the edge of the sheet with respect to the optical sensor by locating the fitted SHAPE CURVE first HIGH-to-LOW transition point in the first direction of travel.

19. The apparatus as set forth in claim 15, wherein the controller for recursively solving comprises:

recursively converging on a lowest sum of square differences in accordance with the equation:

$$\text{error}=\sum_{i=0}^{n}(\text{data curve}_i-\text{shape curve}_i)^2,$$

where n=number of averaged data points.

20. A method for ink-jet printing with, comprising the steps of:

a) providing at least one ink-jet writing instrument fixedly mounted in a hard copy apparatus for scanning across a print media platen;

b) providing at least one optical scanning device, having known operating characteristics, fixedly mounted in a known relationship to the writing instrument for scanning across the print media platen therewith;

c) transporting a sheet of print media to a printing zone on the platen wherein the sheet has a predetermined nominal position on the platen;

d) optically scanning across a region of the sheet near a first edge thereof with the optical scanning device while recording reflectivity data from the sheet with respect to known positions across the platen;

e) optically scanning across the first edge of the sheet while recording reflectivity transition data between the sheet and the platen;

f) optically scanning across a region of the platen while recording platen surface reflectivity data therefrom;

g) calculating a true position of the edge of the sheet from the recording media reflectivity data, the reflectivity transition data, the platen surface reflectivity data, the known operating characteristics of the optical scanning device, and the optical scanning device known relationship to the writing instrument; and h) printing images with the writing instrument relative to the true position of the edge.

21. The method as set forth in claim 20, comprising the steps of:

performing steps d) through g) for each printing swath of the sheet.

22. The method as set forth in claim 21, comprising the steps of:

determining at least one edge at differing points during paper advance, and producing a measurement for calculating media skew therefrom.

23. The method as set forth in claim 20, comprising the steps of:

optically determining a true position of both side edges of the sheet of in accordance with the process steps d) through g), and determining media width with respect to known positions on the platen.

24. The method as set forth in claim 20, comprising the step of:

prior to the step h), determining paper width based on comparing the true position to predetermined ones of the known positions across the platen.

25. The method as set forth in claim 20, comprising the step of:

prior to the step h), measuring any offset due to mechanical tolerances between the ink-jet writing instrument at a home position and the true position of the edge of the sheet.

26. A computer memory device for use with an ink jet printing apparatus having an optical device with a known field of view for making reflectance readings comprising:

means for recording a series of reflectance readings from the sheet and from the platen adjacent at least one edge of the sheet;

means for storing reflectance readings as a first data set;

means for calculating a second data set based on the first data set and the known field of view;

means for calculating a best fit of the second data set to the first data set; and means for determining a reflectance transition point location in the printing zone of the best fit wherein the reflectance transition point is representative of the print medium edge position.

27. The device as set forth in claim 26, comprising:

means for adjusting the print medium edge position with respect to any known writing instrument to optical sensor offset.

28. The device as set forth in claim 26, the means for storing the reflectance readings as a first data set further comprising:

plotting the data as a representative first curve.

29. The device as set forth in claim 28, the means for calculating a second data set further comprising:

means for forming a representative plot having a high value approximately equal to the average of the high values of the first curve and a low value approximately equal to the average of the low values of the first curve and a slope region in accordance with the equation:

slope=(high average reflectance−low average reflectance)÷field of view.

30. The device as set forth in claim 29, the means for calculating a best fit of the data curve to the first data set further comprising:

means for recursively finding a best fit of the representative plot to the first curve.

31. The device as set forth in claim 30, the means for recursively finding a best fit of the representative plot to the first curve further comprising:

means for converging on a lowest sum of square differences in accordance with the equation:

$$\text{error} = \sum_{i=0}^{n} (\text{data curve}_i - \text{shape curve}_i)^2,$$

where n=number of averaged data points.

32. The device as set forth in claim 26, further comprising:

the known field of view is a value in the x-axis for determining left and right edge position.

33. The device as set forth in claim 26, further comprising:

the known field of view is a value in the y-axis for determining top and bottom edge position.

* * * * *